US007351464B2

(12) United States Patent
Poulakis

(10) Patent No.: US 7,351,464 B2
(45) Date of Patent: Apr. 1, 2008

(54) PLANAR ADHESIVE CLOSURE PIECE

(75) Inventor: Konstantinos Poulakis, Hildrizhausen (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 232 days.

(21) Appl. No.: 10/526,463

(22) PCT Filed: Jul. 9, 2003

(86) PCT No.: PCT/EP03/07372

§ 371 (c)(1),
(2), (4) Date: Mar. 3, 2005

(87) PCT Pub. No.: WO2004/021823

PCT Pub. Date: Mar. 18, 2004

(65) Prior Publication Data

US 2005/0268439 A1 Dec. 8, 2005

(30) Foreign Application Priority Data

Sep. 5, 2002 (DE) ..... 102 40 986

(51) Int. Cl.
*B32B 33/00* (2006.01)
*B32B 3/06* (2006.01)
*D03D 3/00* (2006.01)

(52) U.S. Cl. ..... 428/93; 428/92; 428/99; 428/100; 139/384 R; 139/391

(58) Field of Classification Search ..... 428/92, 428/93, 99, 100; 139/384 R, 391
See application file for complete search history.

(56) References Cited

U.S. PATENT DOCUMENTS

| | | | | |
|---|---|---|---|---|
| 5,040,275 | A | 8/1991 | Eckhardt et al. | |
| 6,076,238 | A | 6/2000 | Arsenault et al. | |
| 2001/0035225 | A1 * | 11/2001 | Okawa | 139/383 R |

FOREIGN PATENT DOCUMENTS

| | | | |
|---|---|---|---|
| EP | 0 604 869 | A | 7/1994 |
| EP | 0 682 888 | A | 11/1995 |
| EP | 1 129 639 | A | 9/2001 |

* cited by examiner

*Primary Examiner*—Jenna-Leigh Johnson
(74) *Attorney, Agent, or Firm*—Roylance, Abrams, Berdo & Goodman, L.L.P.

(57) ABSTRACT

A planar adhesive closure piece for an adhesive closure, has detachable closure elements (18) that may be brought into engagement. A base material (14) has warp threads (10) and weft threads (12) and at least one functional thread (16), which partly engages with the base material (14) and which forms the detachable closure elements (18). A planar adhesive closure piece may be produced more economically. Either the warp threads (12) and/or the weft threads (10) are embodied to run with a wave or curve like form. The closure nevertheless has higher adhesive values than closure elements produced with conventional weaving techniques have for closure elements.

11 Claims, 1 Drawing Sheet

PLANAR ADHESIVE CLOSURE PIECE

FIELD OF THE INVENTION

The present invention relates to a planar adhesive closure piece for an adhesive fastener in which fastening elements corresponding to each other may be detachably engaged with each other. A base fabric of warp filaments and weft filaments has at least one functional filament extending at least partly through the base fabric and providing the fastening elements.

BACKGROUND OF THE INVENTION

Woven adhesive fastener portions may have the warp, weft, and functional filaments of textile fibers and of plastic or metal fibers, and are readily available on the market in a plurality of embodiments. The functional filaments form loop-like hooking elements in the base fabric of warp and weft filaments, if they are made of multifilament threads. If the functional filaments are of monofilament threads and if the respective closed loops are cut open or separated from each other by thermal means, fastener hooks are obtained which may be engaged with a correspondingly configured fleece loop material of another fastening element. If in the separating process the free loop ends are subjected to heat treatment, for example, if they are melted open, mushroom-shaped fastener heads are obtained as fastening elements as a result of the inherent behavior of the plastic material. The possibility also exists of engaging hook-shaped or mushroom-shaped fastener portions with felt-like adhesive fastening elements so that the two elements may be separated.

Very good peeling resistance values can be achieved with the disclosed adhesive fastener systems, that is, relatively high forces are required to pull apart the corresponding planar adhesive fastener portions forming the adhesive fastener to discontinue or disengage the connection. However, since the fastening elements of the corresponding fastener portions assume a specific orientation relative to each other, an orientation which is regular from the statistical viewpoint, it has been found in practical applications that after an initial adherence threshold has been crossed the fastener may be easily disengaged. In the respective common orientation, the fastening elements adhering to each other readily slide apart and break the connection.

To counter this problem U.S. Pat. No. 5,040,275 proposes, for a cast adhesive fastener portion, that the fastening elements be configured in sinusoidal paths. Each fastening element has a U-shaped hooked pair provided at its free ends with a mushroom head. In addition, spacing is maintained transversely to the sinusoidal path between the U-shaped fastening elements positioned transversely thereto so that the fastener heads may withdraw into the respective clear space. A suitably configured fastening element may then be received and engaged as free of resistance as possible in formation of the adhesive fastener, for example, also one in the form of a mushroom-shaped hook configuration. As a result of the sinusoidal path in the cast fastener, in which the U-shaped hook elements are cast in a base-matrix material, the rapid slipping off during opening of the fastener in a direction of stripping is prevented. The respective sine wave forces force yielding of the corresponding fastener hook introduced, and results in an obstruction, and accordingly, in an increase in the peeling resistance values. In an improved configuration of this solution (U.S. Pat. No. 6,076,238), the hooking pattern with the fastening elements may be configured "chaotically" in predetermined model patterns, that is, such that the fastening elements are arranged on the base fabric as randomly as possible to achieve an effect comparable to that obtained with the sinusoidal configuration. However, the respective cast plastic fastener cannot be produced as fabric with warp and weft filaments. Also, production of this disclosed fastener is complex and cost-intensive.

SUMMARY OF THE INVENTION

An object of the present invention is to produce a planar adhesive fastener portion as a woven fastener in a cost-effective manner, where the fastener has higher adherence values for the fastening elements than the fasteners hitherto produced in weaving technology with their fastening elements.

This object is basically attained with a planar adhesive fastener portion having either the warp filaments and/or the weft filaments configured to be wave-shaped or curved. The linear orientation on the fastening elements of the adhesive fastener previously extending in one direction is avoided. The curved configuration presents a clearly defined resistance to the disengagement movement of the corresponding fastening elements, so that the retaining forces are essentially constant and thus may also be calculated. The peeling resistance values are distinctly increased in relation to the disclosed solutions made up of fabrics with warp and weft filaments. Preferably, the respective part of the curve or wave is configured as a sinusoidal or cosinusoidal wave.

In an especially preferred embodiment of the adhesive fastener portion of the present invention, the weft filaments exclusively are configured to extend in the form of bights in the base fabric. The respective weft filament extends in an alternating sequence above a warp filament and below the warp filament immediately following. Reliable fastening of the weft filaments in the basic fabric structure is thereby achieved, while the warp filaments, which extend in a linear direction, suitably support the weft filaments in the base fabric.

In another especially preferred embodiment of the adhesive fastener portion of the present invention, the respective functional filament extends at least in part between two adjacent warp filaments in the base fabric, extending below every fourth weft filament and over the other weft filaments. Preferably, in place of the extension below the base fabric of the functional filaments, a loop is formed above the base fabric. Another loop is formed immediately after it.

The respective loops may serve as fleece material for engaging other hooking elements. They may also form the fastener hooks after being cut open or thermally separated. Preferably, the functional filament is a monofilament suitably resistant to the detaching forces and providing the engagement and disengagement forces for the adhesive strip fastener it is desired to produce.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
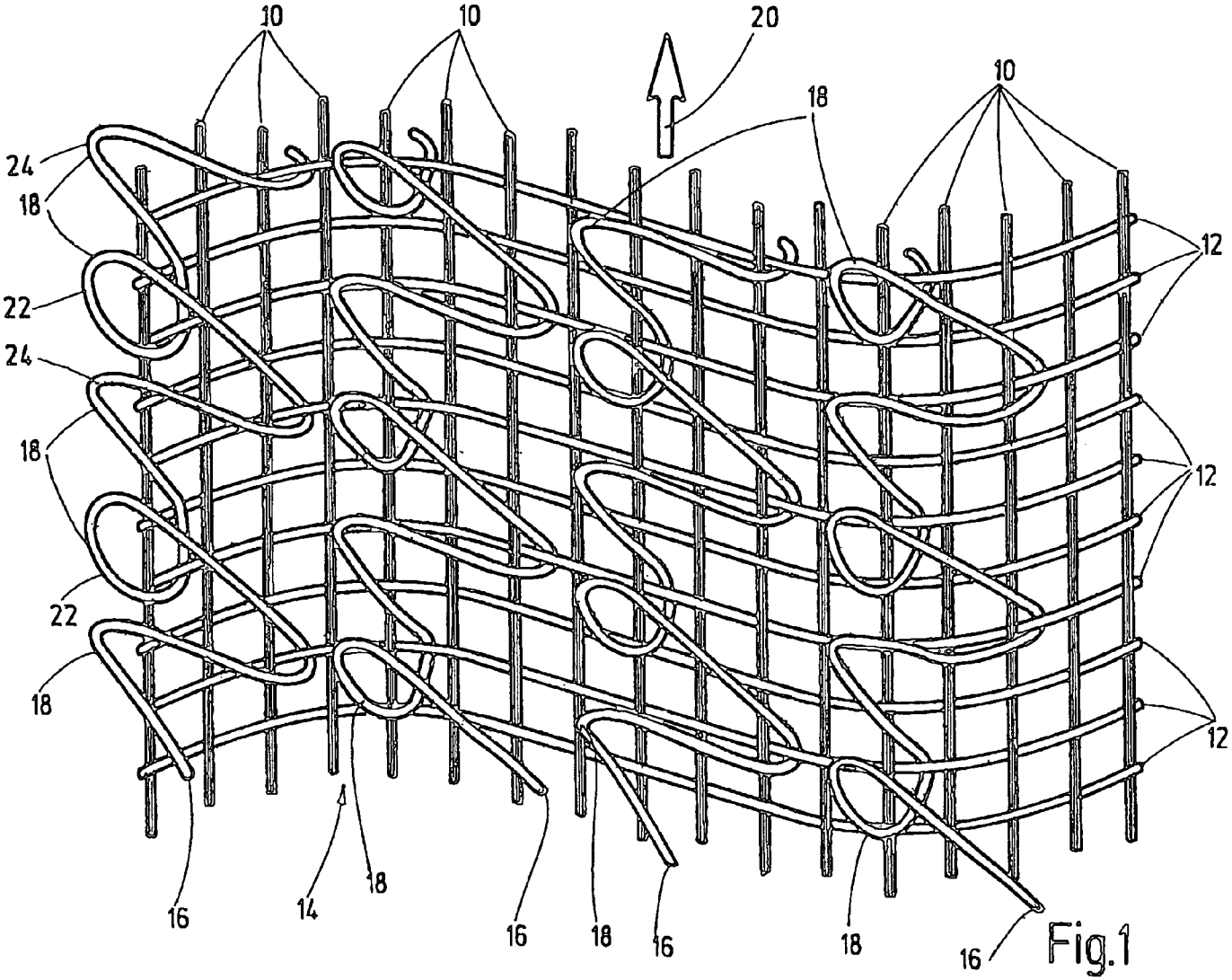
FIG. 1 is a top plan view of a fabric of a planar adhesive fastener portion according to an embodiment of the invention.

FIG. 1 shows a top plan view of a section of a planar adhesive fastener portion according to an embodiment of the present invention. The adhesive fastener portion may be extended as desired in the plane of the drawing in one or the other direction of the illustration. The geometric dimensions of the planar formation depend on the values assigned to the weaving mechanism in which the adhesive fastener portion is produced. The adhesive fastener portion has warp filaments 10 and weft filaments 12 interwoven in a transverse configuration to form the base fabric 14 for the adhesive fastener portion. The base fabric 14 is also configured with functional filaments 16 as pile threads. The respective functional filaments 16 form the individual fastening elements 18 for the planar adhesive fastener portion.

On its upper side, as shown in FIG. 1, an arrow 20 indicates the direction of production of the adhesive fastener portion. In the configuration shown in FIG. 1, the respective weft filaments 12 are configured to be curved as a sine or cosine wave. At the intersections of warp filaments 10 and weft filaments 12, the warp filaments 10 extend in parallel with the direction of production 20 and in parallel with each other in a rectilinear arrangement. In the instance of embodiments not shown of the adhesive fastener portion, it would also be possible to arrange the warp filaments 10 additionally or alternatively in a curved configuration. For the weft filaments 12 to follow a curved path as shown in FIG. 1, the producing loom (not shown) provided for this purpose has a suitably curved reed insert in the form of the sine or cosine wave required. Consequently, the adhesive fastener of the present invention may be made available in large quantities at a high production speed. The sinusoidal or cosinusoidal reed (not shown) engages the respective base fabric 14 transversely to the direction of production 20 to produce the curved weft filament pattern.

In the embodiment shown in FIG. 1, only the weft filaments 12 are arranged to extend in a curved pattern in the base fabric 14. The respective warp filament 12 alternately extends in sequence above a warp filament 10 and below the next one immediately following. The respective functional filaments 16 extend at least partly between two adjacent warp filaments 10 in the base fabric 14. In the configuration shown in FIG. 1, they extend in sequence below every fourth weft filament 12 and above the other weft filaments 12. In place of the respective extension under the base fabric 14 the functional filament 16 forms a superposed loop 22. Another loop 24 is formed immediately after it. In this manner, a sort of V-shaped weave is produced. However, other weave forms are also conceivable, such as tying the functional element 16 in the form of a W or the like.

The loops 22, 24 form the fastening elements 18. If the loops 22, 24 remain closed as illustrated, a sort of fleece adhesive fastener portion is obtained. Hook-shaped or mushroom-shaped fastening elements can engage the respective loops 22, 24 to obtain a detachable adhesive fastener. The possibility also exists, however, of cutting the loops 22, 24 open to produce a fastener hook which may engage corresponding nonwoven or fleece material of another fastening element (not shown). If the separation or cutting process is carried out by thermal means, and if the free loop ends in particular are additionally heated, the ends shrink to form mushroom-shaped fastener hooks, so that the fastener hooks may also be mushroom-shaped (not shown). It accordingly is also possible to produce combined fasteners, that is, ones with hook-shaped and loop-shaped elements on a common base fabric 14.

Figure 2:
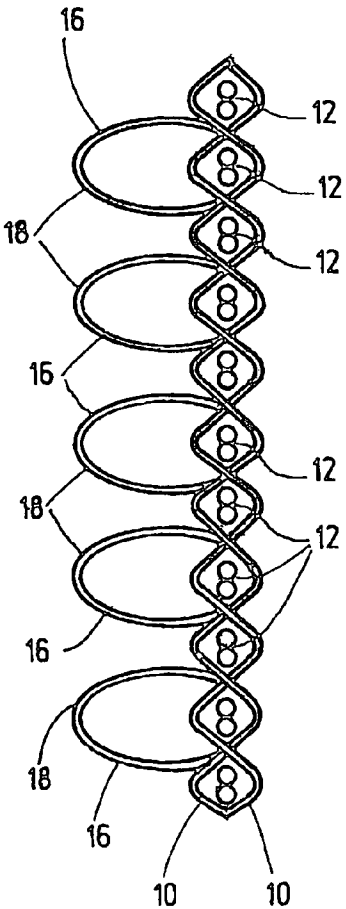
FIG. 2 is a side elevational view of the planar adhesive fastener portion shown in FIG. 1.

As is shown by FIG. 2 in particular, an individual weft filament 12 may be a pair of weft filaments or be in the form of multiple filaments. This form could also apply to the warp filaments 10 as well, which warp filaments are shown by the cross-sectional view in FIG. 2 to extend alternately above a pair of weft filaments 12 and then below this weft filament pair 12. The respective functional or pile thread 16 misses one weft filament pair 12 and then extends over the two following weft filament pairs 12 in the sequence shown.

As is also to be seen in the two illustrations, the other loop 24, in order to extend below the base fabric 14, extends below a weft filament 12. As viewed in the line of sight to FIG. 1, a loop 24 is displaced by two warp filaments 10 and two weft filaments 12 laterally from the point at which the preceding loop 22 is positioned on the base fabric 14. Consequently, the loops of the first type 22 and of the other type 24 are positioned on the base fabric 14 so as to be offset from each other. The loops of the first type 22 form essentially closed O-shaped loops, while the loops of the other type 24 are configured to be V-shaped or U-shaped. A so-called repeat is effected for a functional filament 16 in the direction of the weft filaments 12 after five warp filaments 10. In addition, the filament systems may be formed of textile fibers. Preferably, they are made of a plastic material, nylon or polypropylene in particular. The possibility also exists of using metal fiber systems at least in part for the fastener of the present invention.

The wave-shaped configuration of the weft filaments 12 makes it possible to obtain increased resistance in the direction of peeling during such peeling. Accordingly, in release of the fastener by the correspondingly offset configuration of the loops 22, 24 also configured as hook material, the configuration favors the fastening force behavior and thus results in high fastening and peeling strength values for the fastener.

In addition, it is possible to set the adherence values for the fastener to be as constant as possible, as a function of the configuration of the fastener selected. The adhesive fastener may then always be detached by application of the same detaching force.

While one embodiment has been chosen to illustrate the invention, it will be understood by those skilled in the art that various changes and modifications can be made therein without departing from the scope of the invention as defined in the appended claims.

What is claimed is:

1. A planar adhesive closure piece for a detachable fastener, comprising:

a base fabric of warp filaments and weft filaments, at least one of said warp filaments and said weft filaments extend in a sinusoidal or cosinusoidal wave pattern within a plane parallel to the surface of said base fabric; and a functional filament extending through said base fabric and forming fastener elements detachably engageable with other fastener elements.

2. A planar adhesive closure piece according to claim 1 wherein said weft filaments are exclusively configured as sinusoidal or cosinusoidal waves, each of said weft filaments extending above one of said warp filaments and below another one of said warp filaments following in succession separately from and in addition to said sinusoidal or cosinusoidal waves.

3. A planar adhesive closure piece according to claim 1 wherein said functional filament extends at least in part between two adjacent ones of said warp filaments in said base fabric, and extends below every fourth one of said weft filaments and above other ones of said weft filaments.

4. A planar adhesive closure piece according to claim 3 wherein said functional filament forms a first loop adjacent a point of extension of said functional element from below said base fabric, and forms a second loop immediately following said first loop.

5. A planar adhesive closure piece according to claim 4 wherein extensions of said second loops extend below ones of said weft filaments displaced by two of said warp filaments and two of said weft filaments from points of said first loops on said base fabric.

6. A planar adhesive closure piece according to claim 5 wherein a repeat for said function filament is provided in a direction of said weft filaments after five of said warp filaments.

7. A planar adhesive closure piece according to claim 1 wherein said function filament forms loops which can be cut open at formation points thereof for forming fastener hooks.

8. A planar adhesive closure piece according to claim 1 wherein said function filament is formed of plastic material, and forms loops which can be cut open to provide separated ends subjected to thermal energy to form mushroom-shaped fastener heads.

9. A planar adhesive closure piece according to claim 4 wherein said first loops are offset from said second loops and are configured essentially as closed ring loops, said second loops being V-shaped or U-shaped.

10. A planar adhesive closure piece according to claim 1 wherein at least one of said weft filaments, said warp filaments and said functional filament comprise a filament system with a plurality of filaments.

11. A planar adhesive closure piece according to claim 1 wherein said weft filaments, said warp filaments and said functional filament are formed of nylon or polypropylene material.

* * * * *